US011242832B2

(12) United States Patent
Iwa et al.

(10) Patent No.: US 11,242,832 B2
(45) Date of Patent: Feb. 8, 2022

(54) STRUCTURE FOR ATTACHING METAL DIAPHRAGM DAMPER

(71) Applicant: EAGLE INDUSTRY CO., LTD., Tokyo (JP)

(72) Inventors: Toshiaki Iwa, Tokyo (JP); Yoshihiro Ogawa, Tokyo (JP); Yusuke Sato, Tokyo (JP)

(73) Assignee: EAGLE INDUSTRY CO., LTD.

( * ) Notice: Subject to any disclaimer, the term of this patent is extended or adjusted under 35 U.S.C. 154(b) by 0 days.

(21) Appl. No.: 17/048,992

(22) PCT Filed: May 17, 2019

(86) PCT No.: PCT/JP2019/019616
§ 371 (c)(1),
(2) Date: Oct. 19, 2020

(87) PCT Pub. No.: WO2019/221259
PCT Pub. Date: Nov. 21, 2019

(65) Prior Publication Data

US 2021/0246860 A1 Aug. 12, 2021

(30) Foreign Application Priority Data

May 18, 2018 (JP) ..... JP2018-096188

(51) Int. Cl.
*F02M 55/04* (2006.01)

(52) U.S. Cl.
CPC ..... *F02M 55/04* (2013.01); *F02M 2200/315* (2013.01); *F02M 2200/8084* (2013.01); *F02M 2200/90* (2013.01)

(58) Field of Classification Search
CPC ..... F02M 55/04; F02M 2200/315; F02M 2200/8084; F02M 2200/90; F02M 59/445;

(Continued)

(56) References Cited

U.S. PATENT DOCUMENTS 9,803,600 B2 10/2017 Nah ..... F02M 37/00471
2005/0019188 A1 1/2005 Usui et al. ..... F04B 11/00

(Continued)

FOREIGN PATENT DOCUMENTS

DE 10 2015 223 159 6/2017 ..... F02M 37/00
DE 10 2016 203 217 8/2017 ..... F02M 55/04

(Continued)

OTHER PUBLICATIONS

U.S. Appl. No. 17/048,568, filed Oct. 16, 2020, Sato et al.

(Continued)

*Primary Examiner* — George C Jin

(74) *Attorney, Agent, or Firm* — Hayes Soloway P.C.

(57) ABSTRACT

A structure for attaching a metal diaphragm damper, includes a housing, a housing cover that cooperates with the housing to define a space, and a pair of diaphragms each formed in a disk shape, the pair of diaphragms having weld portions on an outer periphery side thereof, the weld portions being welded to each other in an annular shape to form the metal diaphragm damper of which inside is filled with gas, the metal diaphragm damper being attached to the housing and the housing cover so as to be disposed in the space between the housing and the housing cover. The pair of diaphragms is provided with outer peripheral portions on the outer peripheral side of the welded portions, and the outer peripheral portions of the pair of diaphragms are held by the housing and the housing cover in a thickness direction of the pair of diaphragms.

20 Claims, 7 Drawing Sheets

(58) Field of Classification Search
CPC ..... F02M 59/48; F02M 59/44; F02M 59/36; F02M 55/025
See application file for complete search history.

(56) References Cited

U.S. PATENT DOCUMENTS

| | | | | |
|---|---|---|---|---|
| 2007/0079810 | A1 | 4/2007 | Usui | F02M 63/028 |
| 2008/0175735 | A1 | 7/2008 | Lucas | F02M 37/0041 |
| 2009/0288639 | A1 | 11/2009 | Usui et al. | 123/457 |
| 2010/0209274 | A1 | 8/2010 | Oikawa | F04B 53/004 |
| 2010/0215529 | A1 | 8/2010 | Inoue | F04B 53/002 |
| 2011/0103985 | A1 | 5/2011 | Mancini et al. | F04B 11/00 |
| 2011/0108007 | A1 | 5/2011 | Manchini | F04B 1/0448 |
| 2011/0110807 | A1 | 5/2011 | Kobayashi | F04B 1/0452 |
| 2011/0110808 | A1 | 5/2011 | Inoue | F04B 11/0033 |
| 2011/0209687 | A1 | 9/2011 | Schroeder et al. | F02M 69/00 |
| 2011/0247488 | A1 | 10/2011 | Oikawa | F02M 59/44 |
| 2012/0006303 | A1 | 1/2012 | Usui | F02M 59/44 |
| 2012/0087817 | A1 | 4/2012 | Lucas | F04B 1/0404 |
| 2012/0195780 | A1 | 8/2012 | Matsumoto | F02M 59/02 |
| 2013/0052064 | A1 | 2/2013 | Oikawa | F04B 11/0016 |
| 2013/0209289 | A1* | 8/2013 | Lucas | F04B 11/00 417/395 |
| 2013/0230417 | A1 | 9/2013 | Kobayashi | F16L 55/0338 |
| 2013/0276929 | A1* | 10/2013 | Oikawa | F02M 59/102 138/26 |
| 2014/0193280 | A1 | 7/2014 | Saito | F04B 11/00 |
| 2015/0017040 | A1 | 1/2015 | Hishinuma | F02M 55/04 |
| 2015/0132165 | A1 | 5/2015 | Inoue | F02M 37/043 |
| 2015/0260182 | A1 | 9/2015 | Kobayshi | F04B 43/02 |
| 2016/0169173 | A1 | 6/2016 | Yabuuchi | F02M 59/44 |
| 2016/0195084 | A1 | 7/2016 | Koehler | F02M 55/04 |
| 2018/0195478 | A1 | 7/2018 | Iwa | F16F 1/06 |
| 2018/0202401 | A1 | 7/2018 | Iwa et al. | F02M 55/04 |
| 2018/0209389 | A1* | 7/2018 | Iwa | F16L 55/054 |
| 2018/0223782 | A1 | 8/2018 | Yabuuchi et al. | F02M 55/04 |
| 2018/0274525 | A1 | 9/2018 | Schretling | F04B 11/00 |
| 2018/0306368 | A1 | 10/2018 | Yoshida et al. | F16L 55/053 |
| 2018/0328322 | A1 | 11/2018 | Kashiwagi | F02M 37/0041 |
| 2019/0024646 | A1* | 1/2019 | Kurt | F04B 11/0033 |
| 2019/0048837 | A1 | 2/2019 | Mikhaylov | F04B 53/16 |
| 2019/0063388 | A1* | 2/2019 | Kurt | F02M 55/04 |
| 2019/0285032 | A1 | 9/2019 | Mikhaylov | F04B 53/16 |
| 2021/0164430 | A1 | 6/2021 | Sato | F02M 59/44 |
| 2021/0215127 | A1 | 7/2021 | Kashiwagi | F04B 35/01 |
| 2021/0239080 | A1 | 8/2021 | Sato | F02M 59/36 |
| 2021/0285589 | A1* | 9/2021 | Iwa | F04B 11/0033 |

FOREIGN PATENT DOCUMENTS

| | | | |
|---|---|---|---|
| DE | 10 2016 205 428 | 10/2017 | F04B 11/00 |
| JP | 10-299609 | 11/1998 | F02M 55/00 |
| JP | 2005-42554 | 2/2005 | F02M 59/44 |
| JP | 2007-218264 | 8/2007 | F02M 55/00 |
| JP | 2008-14319 | 1/2008 | F02M 59/44 |
| JP | 2009-264239 | 11/2009 | F02M 59/44 |
| JP | 2012-197732 | 10/2012 | F02M 59/44 |
| JP | 2013-64364 | 4/2013 | F02M 59/44 |
| JP | 2014-190188 | 10/2014 | F02M 55/02 |
| JP | 2015-232283 | 12/2015 | F02M 55/00 |
| JP | 2017-32069 | 2/2017 | F16F 9/04 |
| JP | 2018-71443 | 5/2018 | F02M 59/44 |
| KR | 10-2012-0090452 | 8/2012 | F02M 59/14 |
| WO | WO 2016/190096 | 1/2016 | F02M 59/44 |
| WO | WO 2017/022604 | 2/2017 | F16F 9/04 |
| WO | WO 2017022603 | 2/2017 | B23K 26/28 |
| WO | WO 2017167499 | 10/2017 | B23K 26/28 |

OTHER PUBLICATIONS

U.S. Appl. No. 17/048,980, filed Oct. 19, 2020, Sato et al.
U.S. Appl. No. 17/050,422, filed Oct. 23, 2020, Iwa et al.
U.S. Appl. No. 17/052,168, filed Oct. 30, 2020, Iwa et al.
International Preliminary Report on Patentability issued in PCT/JP2019/019619, dated Nov. 24. 2020, with English translation, 10 pages.
International Search Report and Written Opinion issued in PCT/JP2019/019619, dated Aug. 13, 2019, with English translation, 18 pages.
International Preliminary Report on Patentability issued in PCT/JP2019/019618, dated Nov. 24. 2020, with English translation, 10pages.
International Search Report and Written Opinion issued in PCT/JP2019/019618, dated Jun. 25, 2019, with English translation, 19 pages.
International Preliminary Report on Patentability issued in PCT/JP2019/019616, dated Nov. 24, 2020, with English translation, 6 pages.
International Search Report and Written Opinion issued in PCT/JP2019/019616, dated Jul. 9, 2019, with English translation, 11 pages.
International Preliminary Report on Patentability issued in PCT/JP2019/020195, dated Dec. 1, 2020, with English translation, 7 pages.
International Search Report and Written Opinion issued in PCT/JP2019/020195, dated Jul. 30, 2019, with English translation, 12 pages.
International Preliminary Report on Patentability issued in PCT/JP2019/019615, dated Nov. 24, 2020, with English translation, 7 pages.
International Search Report and Whitten Opinion issued in PCT/JP2019/019615, dated Aug. 13, 2019, with English translation, 15 pages.
U.S. Appl. No. 17/048,992, filed Oct. 19, 2020, Iwa et al.
U.S. Appl. No. 17/048,568, filed 00/16/2020, Sato et al.
Official Action dated Jun. 18, 2021, issued in related U.S. Appl. No. 17/050,422, 15 pages.
Official Action dated Aug. 26, 2021, issued in related U.S. Appl. No. 17/052,168, 29 pages.

* cited by examiner (b)

(a)

(b)

STRUCTURE FOR ATTACHING METAL DIAPHRAGM DAMPER

TECHNICAL FIELD

The present invention relates to a structure for attaching a metal diaphragm damper for pulsation absorption that is used at a position where pulsation is generated in a high-pressure fuel pump and the like.

BACKGROUND ART

There is a high-pressure fuel pump for pumping fuel, which is supplied from a fuel tank, to an injector. The high-pressure fuel pump pressurizes and discharges fuel by the reciprocation of a plunger that is driven by the rotation of a cam shaft of an internal-combustion engine. Since pulsation is generated in a fuel chamber due to a change in the amount of fuel discharged to the injector from the high-pressure fuel pump or a change in the amount of fuel injected from the injector, a metal diaphragm damper for reducing pulsation generated in the fuel chamber is generally built in the high-pressure fuel pump.

For example, two disc-shaped diaphragms are welded to each other at the outer peripheral edge portions thereof, so that a hermetically sealed space filled with gas having a predetermined pressure is formed in a metal diaphragm damper disclosed in Patent Citation 1; and the metal diaphragm damper is provided in a fuel chamber. The fuel chamber is a space formed between a housing and a housing cover, and an annular attachment member is mounted on the inner peripheral surface of the fuel chamber by frictional engagement. The attachment member includes clip-shaped holders at a plurality of positions thereon in a circumferential direction and the outer peripheral edge portions of the diaphragms are held by the holders, so that the metal diaphragm damper is installed so as to partition the fuel chamber. Further, fuel can flow around to the spaces formed on both the surface side and back side of the metal diaphragm damper in the fuel chamber through a radial gap between the attachment member and the metal diaphragm damper.

Since the respective diaphragms of the metal diaphragm damper are elastically deformed by fuel pressure accompanied by pulsation, the volume of the fuel chamber can be changed and pulsation is reduced. For example, the metal diaphragm damper is adapted to be capable of reducing pulsation while the outer peripheral edge portions of the diaphragms or the attachment member is deformed and both the diaphragms are integrally moved to the other side when the metal diaphragm damper receives pulsation accompanied by shock waves from one side thereof.

CITATION LIST

Patent Literature

Patent Citation 1: JP 2014-190188 A (page 7, FIG. 2)

SUMMARY OF INVENTION

Technical Problem

Since the metal diaphragm damper disclosed in Patent Citation 1 allow the elastic deformation of the respective diaphragms and the integrated movement of both the diaphragms, high pulsation reduction capability can be achieved. However, since the separate attachment member is used to hold the metal diaphragm damper, the number of parts is large and the structure is complicated. For this reason, assembly work and the like are inconvenient. Further, since the clip-shaped holders hold the diaphragms over the inner peripheral side from the outer peripheral edge portions that are welded portions of the diaphragms, the holders affect the deformation of deformable portions of the diaphragms closer to the inner peripheral side than the welded portions.

The present invention has been made in consideration of such problems, and an object of the present invention is to provide a structure for attaching a metal diaphragm damper that can fulfill an excellent pulsation-reducing function with a simple structure.

Solution to Problem

In order to solve the above-mentioned problem, a structure for attaching a metal diaphragm damper according to the present invention includes: a housing; a housing cover that cooperates with the housing to define a space between the housing and the housing cover; and a pair of diaphragms each formed in a disk shape, the pair of diaphragms having weld portions on an outer periphery side thereof, the weld portions being welded to each other in an annular shape to form the metal diaphragm damper of which inside is filled with gas, the metal diaphragm damper being attached to the housing and the housing cover so as to be disposed in the space between the housing and the housing cover, wherein the pair of diaphragms is provided with outer peripheral portions on the outer peripheral side of the welded portions, and the outer peripheral portions of the pair of diaphragms are held by the housing and the housing cover in a thickness direction of the pair of diaphragms. According to the aforesaid feature, since the outer peripheral portions of the diaphragms are directly held by the housing and the housing cover, a separate attachment member and the like do not need to be prepared. Further, when the metal diaphragm damper receives pulsation accompanied by shock waves from one side of the diaphragms, the outer peripheral portions are deformed so that the portions of the diaphragms closer to the inside than the welded portion are allowed to move to the other side. Accordingly, an excellent pulsation-reducing function can be achieved with a simple structure.

It may be preferable that the outer peripheral portions of the pair of diaphragms are formed to be opened in a direction where the outer peripheral portions are spaced apart from each other as going toward the outside in a radial direction. According to this preferable configuration, since elastic restoring forces act when the outer peripheral portions are held by the housing and the housing cover, the metal diaphragm damper can be reliably attached.

It may be preferable that the outer peripheral portions are provided with communication passages which allow both sides of the outer peripheral portions in a thickness direction thereof to communicate with each other. According to this preferable configuration, communication passages allowing fluid to flow around to the diaphragms provided on both the surface side and back side of the metal diaphragm damper can be easily formed.

It may be preferable that the communication passages are formed by cutouts of outer edges of the outer peripheral portions. According to this preferable configuration, the communication passages can be formed even though the outer peripheral portions are small.

It may be preferable that communication grooves are formed over the housing and the housing cover. According to this preferable configuration, communication passages of which the cross-sectional area of flow channels is large can be formed by the communication passages of the diaphragms and the communication grooves of the housing.

It may be preferable that the pair of diaphragms is provided with curved portions which are formed on an inner peripheral side of the weld portions so as to be spaced apart from each other as going toward a radially inward side from base end portions inwardly continuous with the welded portions, the base end portions being brought into contact with each other. According to this preferable configuration, it is possible to suppress the application of stress to the welded portion by concentrating stress on the base end portions of the curved portions.

It may be preferable that the outer peripheral portions of the pair of diaphragms are held by the housing and the housing cover in a state where the outer peripheral portions of the pair of diaphragms are spaced from each other. According to this preferable configuration, the metal diaphragm damper can be reliably attached by the elastic restoring forces of the outer peripheral portions regardless of the dimensional accuracy of the housing and the housing cover.

It may be preferable that the outer peripheral portions of the pair of diaphragms are held by the housing and the housing cover in a state where the outer peripheral portions of the pair of diaphragms are in contact with each other. According to this preferable configuration, the outer peripheral portions can be made to be deformed integrally.

DESCRIPTION OF EMBODIMENTS

Modes for implementing a metal diaphragm damper according to the present invention will be described below on the basis of embodiments.

First Embodiment

A structure for attaching a metal diaphragm damper according to a first embodiment of the present invention will be described with reference to FIGS. 1 to 5.

Figure 1:
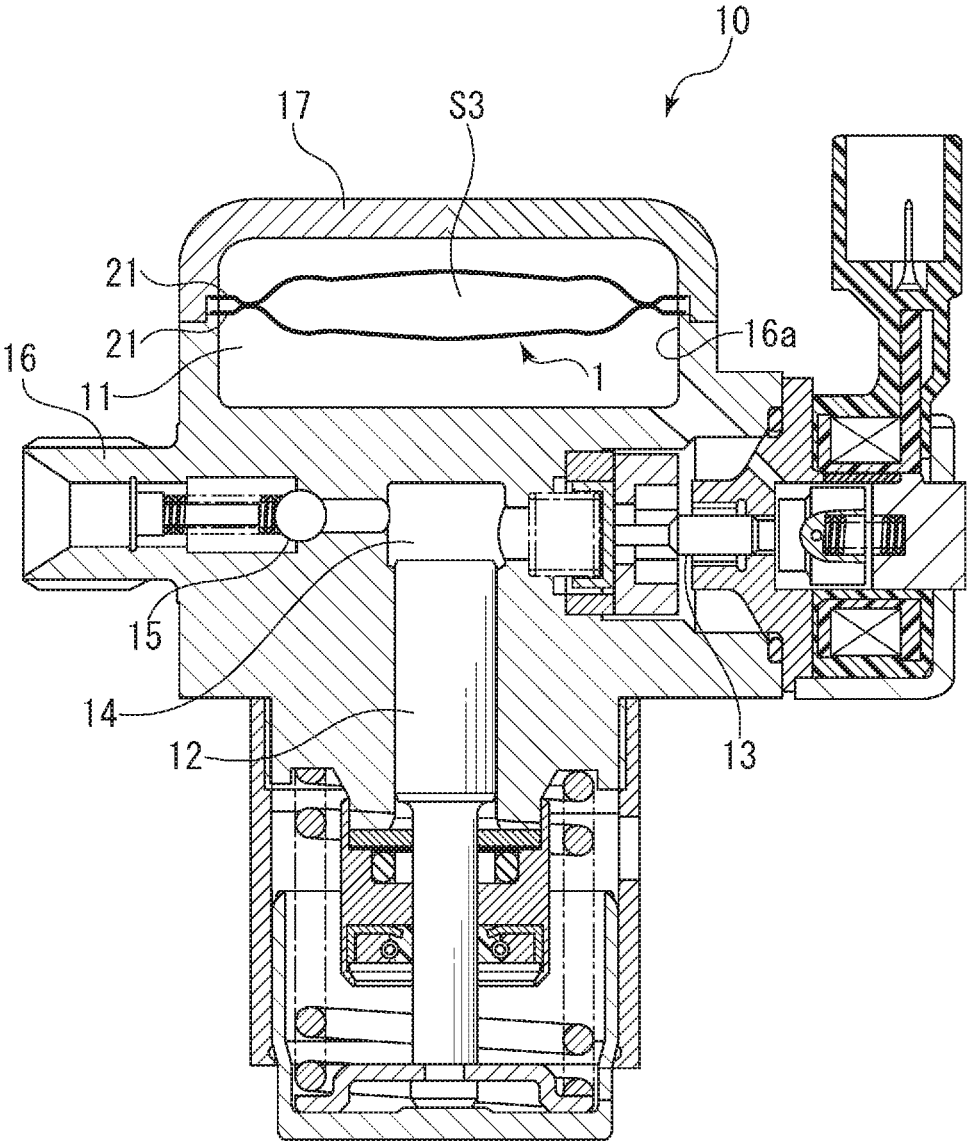
FIG. 1 is a cross-sectional view of a high-pressure fuel pump in which a metal diaphragm damper according to a first embodiment of the present invention is built.

As illustrated in FIG. 1, a metal diaphragm damper 1 of the present embodiment is built in a high-pressure fuel pump 10 for pumping fuel, which is supplied from a fuel tank through a fuel inlet (not illustrated), to an injector. The high-pressure fuel pump 10 pressurizes and discharges fuel by the reciprocation of a plunger 12 that is driven by the rotation of a cam shaft (not illustrated) of an internal-combustion engine.

As a mechanism for pressurizing and discharging fuel in the high-pressure fuel pump 10, an intake stroke for opening an intake valve 13 and taking in fuel to a pressurizing chamber 14 from a fuel chamber 11 formed on a fuel inlet side, when the plunger 12 is moved down, is performed first. Then, an amount adjustment stroke for returning a part of the fuel of the pressurizing chamber 14 to the fuel chamber 11, when the plunger 12 is moved up, is performed, and a pressurization stroke for pressurizing fuel, when the plunger 12 is further moved up after the intake valve 13 is closed, is performed. As described above, the high-pressure fuel pump 10 repeats a cycle that includes the intake stroke, the amount adjustment stroke, and the pressurization stroke, to pressurize fuel, to open a discharge valve 15, and to discharge the fuel to the injector. In this case, pulsation in which high pressure and low pressure are repeated is generated in the fuel chamber 11 due to a change in the amount of fuel discharged to the injector from the high-pressure fuel pump 10 or a change in the amount of fuel injected from the injector.

The metal diaphragm damper 1 of the present embodiment is used to reduce such pulsation that is generated in the fuel chamber 11 of the high-pressure fuel pump 10 (i.e., a space between the housing and the housing cover). Meanwhile, the metal diaphragm damper 1 is disposed to partition the fuel chamber 11 of the high-pressure fuel pump 10 into an upper space and a lower space. The fuel chamber 11 is formed by a recessed portion 16*a* that is formed in a housing 16 of the high-pressure fuel pump 10 to be recessed down and a housing cover 17 that has a downward U-shaped cross-section and closes the recessed portion 16*a*. Outer peripheral portions 21 and 21, which are to be described later, of the metal diaphragm. damper 1 are held between the housing 16 and the housing cover 17.

Figure 2:
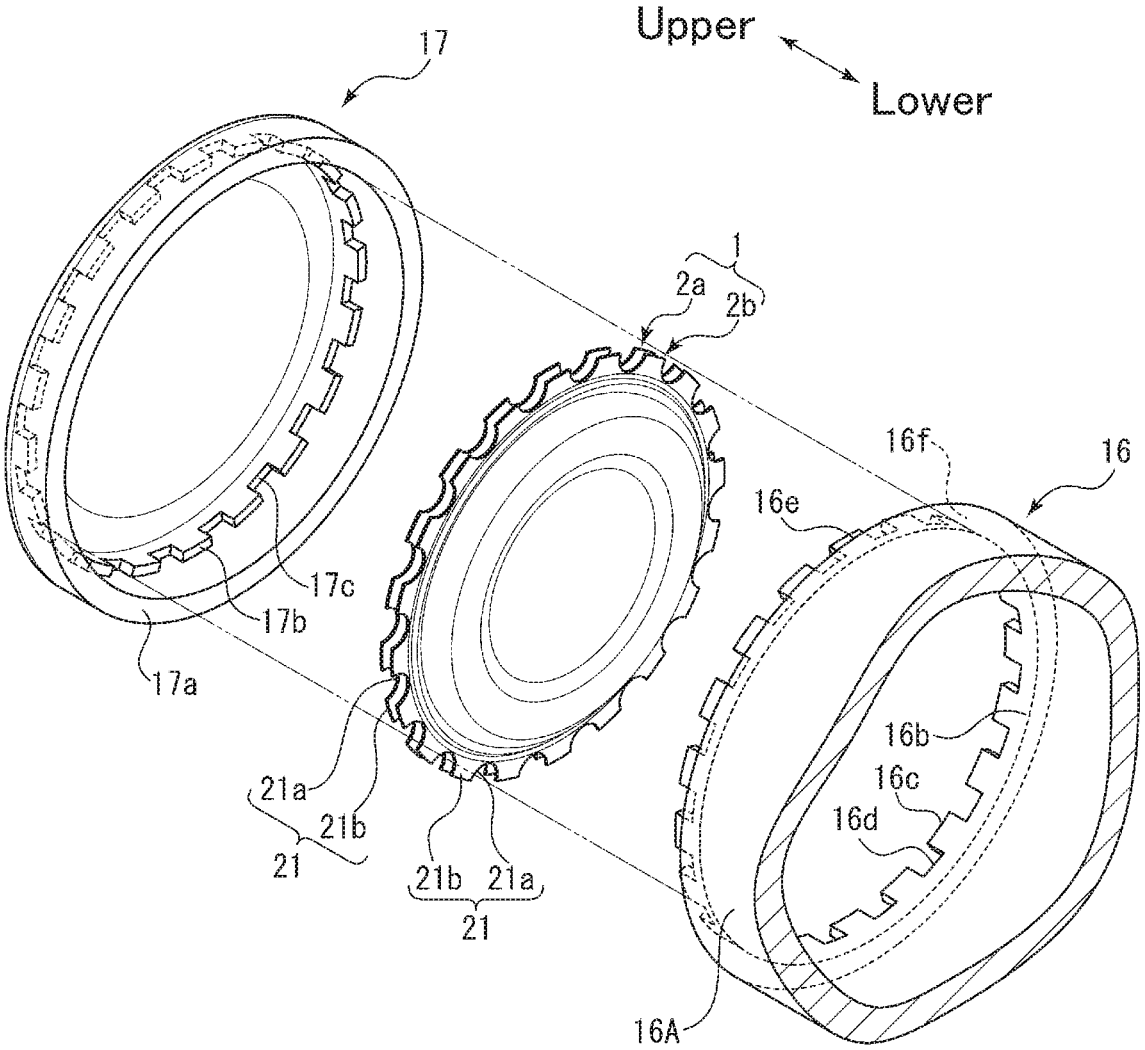
FIG. 2 is an exploded perspective view illustrating a structure around the metal diaphragm damper according to the first embodiment.
Figure 4:
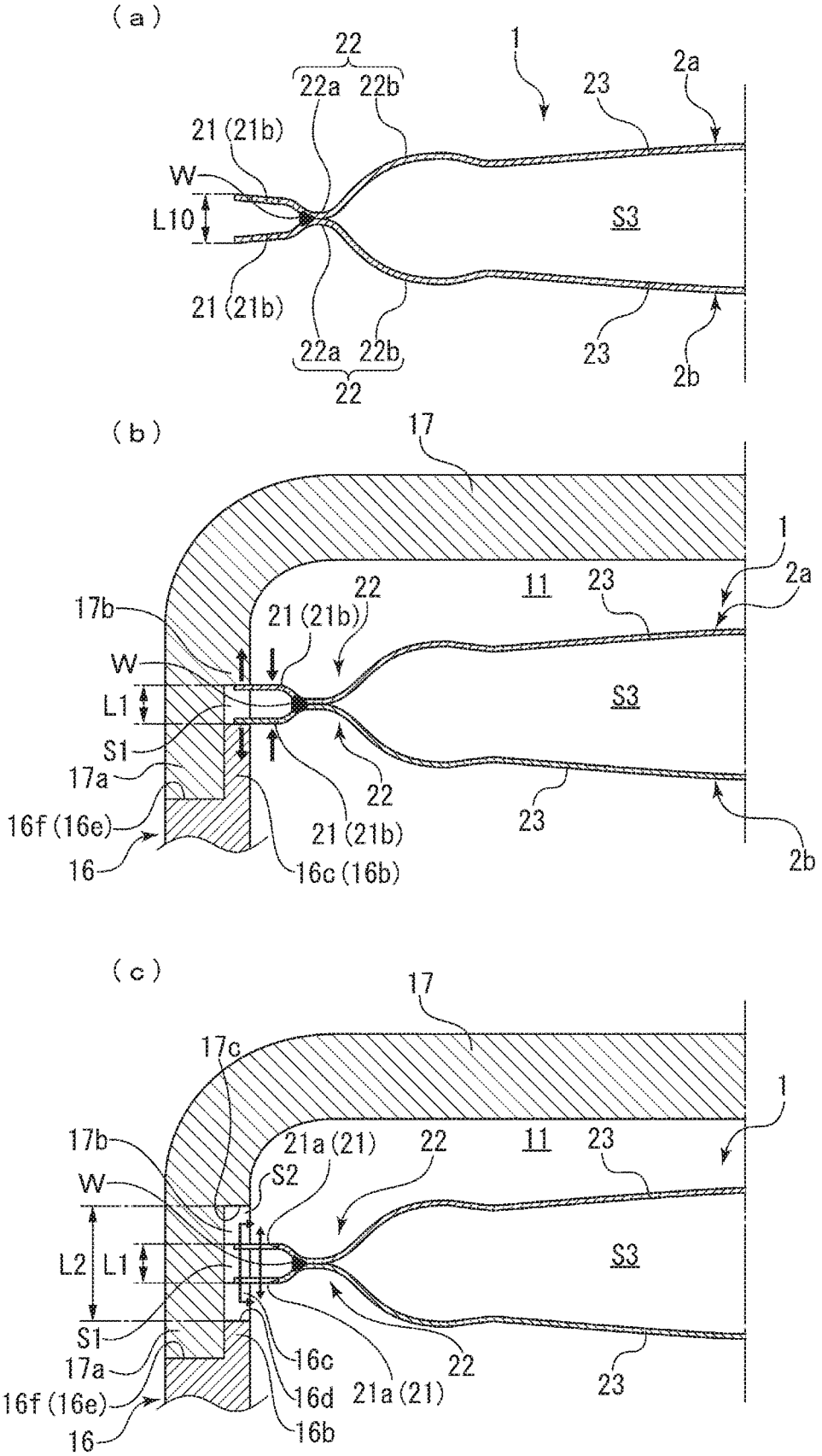
FIG. 4A is a cross-sectional view illustrating the structure of an outer peripheral portion of the metal diaphragm damper according to the first embodiment.
FIG. 4B is a cross-sectional view taken along line A-A.
FIG. 4C is a cross-sectional view taken along line B-B.
Figure 5:
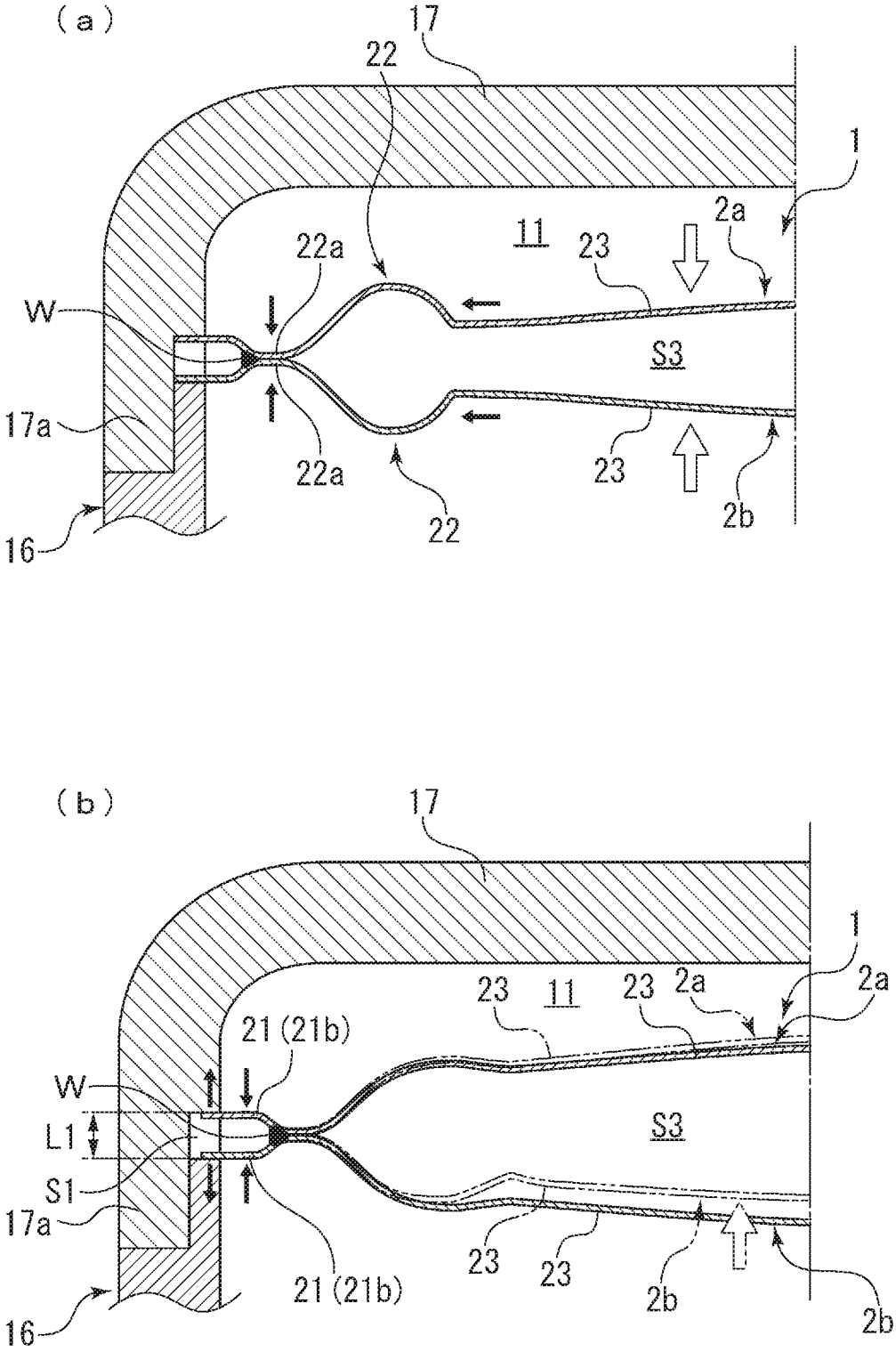
FIG. 5A is a cross-sectional view illustrating a state at the time of contraction of the diaphragms according to the first embodiment.
FIG. 5B is a cross-sectional view illustrating a state at the time of movement of a diaphragm of the first embodiment.

As illustrated in FIGS. 2 and 4, an annular wall portion 16*b*, which is thinner than a housing body portion 16A, is formed on the inner peripheral side of the upper edge of the housing 16 to extend upward, and a stepped portion 16*e* is formed between the wall portion 16*b* and the housing body portion 16A. The stepped portion 16*e* is formed by the outer peripheral surface of the wall portion 16*b*, a horizontal surface 16*f* that extends toward an outer peripheral side so as to be perpendicular to the wall portion 16*b*, and the outer peripheral surface of the housing body portion 16A that extends from the outer edge of the horizontal surface 16*f* as to be perpendicular to the horizontal surface 16*f*. Further, convex portions 16*c* extending upward are formed on the wall portion 16*b* so as to be spaced apart from each other at predetermined intervals in a circumferential direction. That is, a concave portion 16*d*, which is formed by the side surfaces of the convex portions 16*c* and the upper end face of the wall portion 16*b*, is formed between the adjacent convex portions 16*c*. For the convenience of illustration, the lower structure of the housing 16 is not illustrated in FIG. 2.

A tubular portion 17*a* to be externally fitted to the wall portion 16*b* is formed at the lower end portion of the housing cover 17. In a state where the tubular portion 17*a* is externally fitted to the wall portion 16*b*, the lower end face of the tubular portion 17*a* is in contact with the horizontal surface 16*f* of the stepped portion 16*e* and is positioned in a vertical direction.

Convex portions 17*b* and concave portions 17*c* are formed on the inner peripheral side of the tubular portion 17*a*. The convex portions 17*b* extend toward the convex portions 16*c* so as to face the convex portions 16*c* with a distance L1 (see FIG. 4B) interposed therebetween in the vertical direction in a state where the tubular portion 17*a* is externally fitted to the wall portion 16*b*, and concave portions 17*c* are recessed toward the opposite side (i.e., upper side) so as to face the concave portions 16*d*. As described above, the convex portions 16*c* and 17*b* are arranged at positions opposite to each other with respect to the metal diaphragm damper 1 in the vertical direction. The same applies to the concave portions 16*d* and 17*c*.

That is, in a state where the housing cover 17 is attached to the housing 16, a distance L2 (see FIG. 4C) between the concave portions 16*d* and 17*c* is longer than the distance L1 between the convex portions 16*c* and 17*b* and gaps S1 (see FIG. 4B) formed between the convex portions 16*c* and 17*b* and gaps S2 (see FIG. 4C) formed between the concave portions 16*d* and 17*c* are provided inside the housing 16 and the housing cover 17, are recessed toward the outer peripheral side, and are continuous over the circumferential direction. Meanwhile, the housing 16 and the housing cover 17 are fixed to each other in a hermetically sealed state by laser welding.

As illustrated in FIGS. 1 and 2, two disc-shaped diaphragms 2*a* and 2*b* are airtightly joined to each other over the entire circumference by laser welding, so that the metal diaphragm damper 1 is formed in the shape of a disc.

In detail, a welded portion W (see particularly FIG. 4A) is formed at the inner portions of the diaphragms 2*a* and 2*b* so that outer peripheral portions 21 and 21 remain, and a plurality of notches 21*a* and 21*a*, which are recessed toward the inner peripheral side and have a U shape in plan view, are formed at the outer edges of the outer peripheral portions 21 and 21 in the circumferential direction (Meanwhile, the notches 21*a* and 21*a* do not necessarily need to be formed by notching and have only to have a notched shape). That is, a plurality of plate-like portions 21*b* (that is, remaining portions other than the notches 21*a*) having the shape of a chevron in plan view are formed at the outer peripheral portions 21. The diaphragms 2*a* and 2*b* are fixed to each other by welding in a state where the positions of the respective notches 21*a* and the respective plate-like portions 21*b* of the diaphragms 2*a* and 2*b* in the circumferential direction are aligned with each other. Meanwhile, the outer peripheral portions 21 of the present embodiment mean the portions of the diaphragms 2*a* and 2*b* closer to the outer peripheral side than the welded portion W.

A hermetically sealed space S3 formed between the diaphragms 2*a* and 2*b* joined to each other (that is, the interior space of the metal diaphragm damper 1 (see FIGS. 1 and 4)) is filled with gas that is formed of argon, helium, and the like and has predetermined pressure. Meanwhile, the amount of change in the volume of the metal diaphragm damper 1 is adjusted using the pressure of gas to be filled in the hermetically sealed space S3, so that preferable pulsation absorption performance can be obtained.

Figure 3:
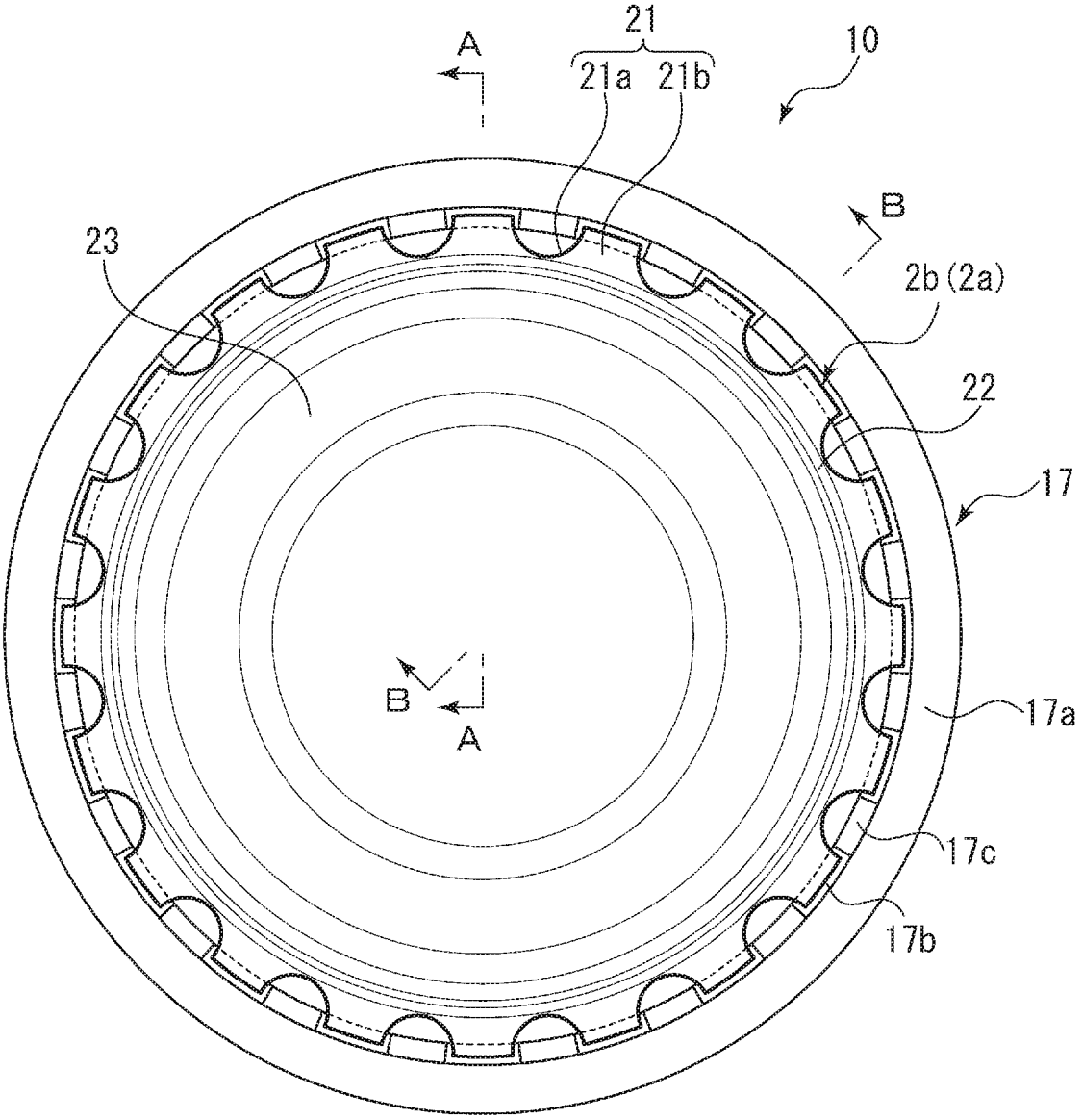
FIG. 3 is a bottom view illustrating a state where the metal diaphragm damper according to the first embodiment is attached between a housing and a housing cover.

As illustrated in FIGS. 3 and 4, each of the diaphragms 2*a* and 2*b* is formed by the pressing of a metal plate, and the outer peripheral portion 21, a curved portion 22, and a deformable-action portion 23 close to the central side (i.e., inner peripheral side) are formed at each of the diaphragms 2*a* and 2*b* in this order from the outer peripheral side. The metal plates forming the diaphragms 2*a* and 2*b* are two metal plates that are made of the same material and have substantially the same shape; are stacked on each other and are laser-welded at the welded portion W; and have a uniform thickness as a whole. Actually, the housing 16 is present on the front side of the plane of FIG. 3. However, for the convenience of illustration, the components of the housing 16 are not illustrated in FIG. 3.

Particularly, as illustrated in FIG. 4A, the plate-like portions 21*b* and 21*b*, which are the outer peripheral portions 21 and 21 of the diaphragms 2*a* and 2*b*, are formed to be opened in a direction where the plate-like portions 21*b* and 21*b* are spaced apart from each other (are spaced apart from each other in a vertical direction in FIG. 4. The same hereinafter), as going toward the outside in a radial direction. Further, the curved portions 22 and 22 of the diaphragms 2*a* and 2*b* are curved toward the inner peripheral side from the welded portion W so as to have an S-shaped cross-section; first curved portions 22*a* and 22*a*, which are base end portions close to the welded portion W, are curved so that the apexes of the first curved portions 22*a* and 22*a* approach each other; and second curved portions 22*b* and 22*b* close to the deformable-action portions 23 are curved so as to be spaced apart from each other. Meanwhile, the first curved portions 22*a* and 22*a* are in contact with each other when pulsation does not act on the diaphragms 2*a* and 2*b* (that is, when low pressure is generated in the fuel chamber 11).

The deformable-action portion 23 is a portion that is formed in a dome shape and is to be elastically deformed by differential pressure between external pressure and the pressure of gas to be filled in the hermetically sealed space S3. Meanwhile, the shape of the deformable-action portion 23 may be the shape of a single continuous curved surface, or may be a shape including a plurality of curved surfaces, for example, the shape of a corrugated plate in cross-sectional view. That is, the shape of the deformable-action portion 23 may be freely changed.

As illustrated in FIGS. 3 and 4B, the respective plate-like portions 21*b* of the diaphragms 2*a* and 2*b* of the metal diaphragm damper 1 are held (in the gaps S1) between the convex portions 16*c* of the housing 16 and the convex portions 17*b* of the housing cover 17 in a thickness direction.

Specifically, in a state where the plate-like portions 21*b* and 21*b*, which are the outer peripheral portions 21 and 21, are not yet held between the convex portions 16*c* and 17*b* (see FIG. 4A), the outer edges of the outer peripheral portions 21 and 21 are spaced apart from each other in the thickness direction by a distance L10. Further, in a state where the plate-like portions 21*b* and 21*b*, which are the outer peripheral portions 21 and 21, are held between the convex portions 16*c* and 17*b* (see FIG. 4B), the outer edges of the outer peripheral portions 21 and 21 are spaced apart from each other in the thickness direction by the distance L1 shorter than the distance L10 and are parallel to each other (i.e., L1<L10). That is, since the elastic restoring forces of the outer peripheral portions 21 and 21 act on the convex portions 16*c* and 17*b* when the outer peripheral portions 21 and 21 are held between the convex portions 16*c* and 17*b*, the metal diaphragm damper 1 can be reliably attached without rattling regardless of the dimensional accuracy of the housing 16 and the housing cover 17. Further, since the outer diameter of the metal diaphragm damper 1 is smaller than the inner diameter of the tubular portion 17*a*, a gap is formed between the metal diaphragm damper 1 and the tubular portion 17*a* in the radial direction.

As illustrated in FIGS. 3 and 4C, apart of each of the notches 21*a* of the diaphragms 2*a* and 2*b* is disposed in the fuel chamber 11 in a state where the metal diaphragm damper 1 is attached between the housing 16 and the housing cover 17. For this reason, fuel present in the fuel chamber 11 can be moved to one side (i.e., lower side) and the other side (upper side) of the metal diaphragm damper 1 through the respective notches 21*a*.

Further, the respective notches 21*a* communicate with the gaps S2 (i.e., communication grooves) formed between the concave portions 16*d* and 17*c*, and the gaps S2 are larger than the gaps S1 in the vertical direction. That is, since the respective notches 21*a* and the gaps S2 function as communication passages that allow one side and the other side of the metal diaphragm damper 1 to communicate with each other, the cross-sectional area of the flow channels of the communication passages can be increased. Furthermore, since the gaps S1 and S2 are continuous over the circumferential direction, the cross-sectional area of the flow channels of the communication passages can be increased in comparison with a case where the gaps S1 and S2 are discontinuous in the circumferential direction. Moreover, since the notches 21*a* are formed by notching of the outer edges of the outer peripheral portions 21 and 21, the communication passages can be formed even in a case where the widths of the outer peripheral portions 21 and 21 in the radial direction are small.

Next, an operation will be described. When fuel pressure accompanied by pulsation is changed to high pressure from low pressure and the diaphragms 2*a* and 2*b* substantially uniformly receive fuel pressure from the fuel chamber 11, the deformable-action portions 23 and 23 are deformed to be crushed toward the hermetically sealed space S3 as illustrated in FIG. 5A. Meanwhile, since the deformable-action portions 23 and 23 are crushed toward the hermetically sealed space S3, the gas filled in the hermetically sealed space S3 is compressed.

When the deformable-action portions 23 and 23 are crushed toward the hermetically sealed space S3, the diameters of the diaphragms 2*a* and 2*b* are increased outward in the radial direction. Since a gap is formed between the metal diaphragm damper 1 and the tubular portion 17*a* in the radial direction as described above, an increase in the diameters of the diaphragms 2*a* and 2*b* is allowed and the curved portions 22 and 22 provided closer to the inner peripheral side than the welded portion W are deformed. Particularly, since the curved portions 22 and 22 are deformed in a direction where the curved portions 22 and 22 approach each other, the first curved portions 22*a* and 22*a* are more strongly pushed against each other. Accordingly, stress is concentrated on the first curved portions 22*a* and 22*a*. Therefore, since it is difficult for high stress to be applied to the welded portion W, the breakage of the welded portion W is prevented.

Since the outer peripheral portions 21 and 21 closer to the outer peripheral side than the welded portion W are held by the housing 16 and the housing cover 17 as described above, the housing 16 and the housing cover 17 are not in contact with the deformable-action portions 23 and 23 disposed closer to the inner peripheral side than the welded portion W. Accordingly, the housing 16 and the housing cover 17 do not inhibit the elastic deformation of the deformable-action portions 23 and 23. That is, the housing 16 and the housing cover 17 can be adapted not to affect a pulsation-reducing function.

Further, since the outer peripheral portions 21 and 21 of the diaphragms 2*a* and 2*b* are directly held by the housing 16 and the housing cover 17, a separate attachment member and the like do not need to be prepared. Accordingly, the number of parts can be reduced. That is, in the structure for attaching the metal diaphragm damper 1 according to the present embodiment, an excellent pulsation-reducing function can be achieved with a simple structure. Further, since the housing 16 and the housing cover 17 having high strength hold the outer peripheral portions 21 and 21, the metal diaphragm damper 1 can be reliably held in comparison with a case where the metal diaphragm damper 1 is held by the separate attachment member.

Further, when the metal diaphragm damper 1 receives large pulsation accompanied by shock waves from one side (lower side) thereof as illustrated in FIG. 5B, the diaphragm damper 1 is adapted to reduce a force caused by the shock waves by being curved toward the other side (i.e., upper side) as a whole immediately afterwards.

Specifically, when portions of the diaphragms 2*a* and 2*b* closer to the inside than the welded portion W receive a force, which is applied toward the upper side of the metal diaphragm damper 1, as a whole, the outer peripheral portion 21 of the diaphragm 2*a* and the outer peripheral portion 21 of the diaphragm 2*b* are elastically deformed or start to move rotationally from the gap S1 substantially at the same time. Since fuel is present on the upper side of the curved portion 22 and the deformable-action portion 23 of the diaphragm 2*a*, the curved portion 22 and the deformable-action portion 23 of the diaphragm 2*a* are slightly bent upward. On the other hand, the curved portion 22 and the deformable-action portion 23 of the diaphragm 2*b* are further pushed up and is deformed to be crushed toward the hermetically sealed space S3 (see FIG. 5B). After that, when high pressure is transmitted to even the diaphragm 2*a*, the diaphragm 2*a* is also crushed toward the hermetically sealed space S3. As a result, the diaphragm damper 1 is deformed (see FIG. 5A).

Since the welded portion W is provided closer to the inside than the outer peripheral portions 21 and 21 that are the fixed portions of the metal diaphragm damper 1 as described above, the portions of the diaphragms 2*a* and 2*b* closer to the inside than the welded portion W can be moved through the deformation of the outer peripheral portions 21 and 21. Accordingly, large pulsation accompanied by shock waves can be reduced.

Further, when the metal diaphragm damper 1 receives large pulsation accompanied by shock waves and is moved to the other side from one side, the outer peripheral portion 21 of the diaphragm 2*a* and the outer peripheral portion 21 of the diaphragm 2*b* are separately elastically deformed or move rotationally and the outer peripheral portion 21 of the diaphragm 2*a* and the outer peripheral portion 21 of the diaphragm 2*b* are subjected to different deformation. Accordingly, stress can be distributed to different positions on the outer peripheral portions 21 and 21, so that the breakage of the outer peripheral portions 21 and 21 can be suppressed.

Meanwhile, the portions of the diaphragms 2*a* and 2*b* closer to the inside than the welded portion W may be moved to the lower side from the upper side in some types of high-pressure fuel pump 10 to which the metal diaphragm damper 1 is applied.

Second Embodiment

Figure 6:
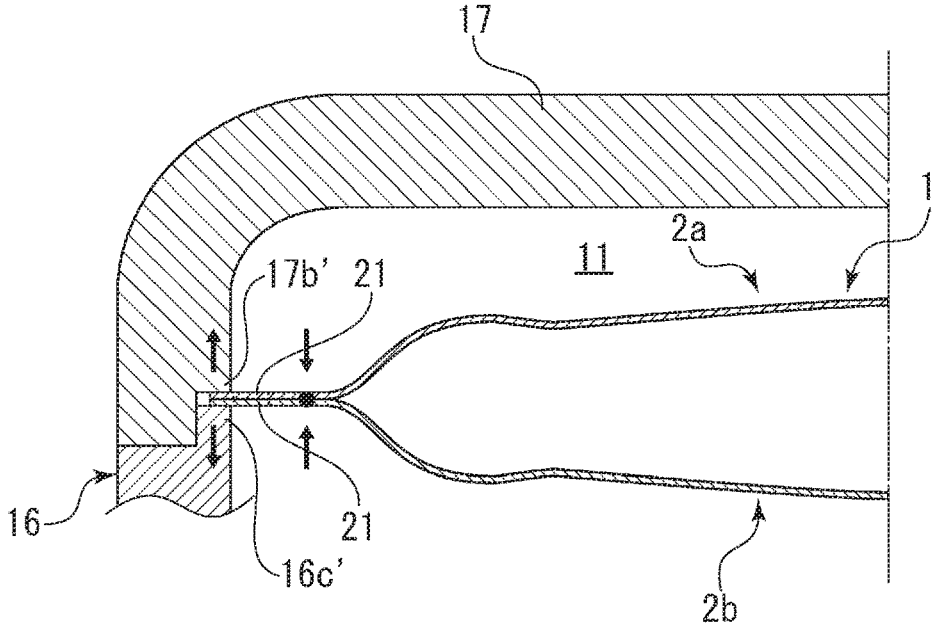
FIG. 6A is a cross-sectional view illustrating a state where a metal diaphragm damper according to a second embodiment of the present invention is attached between a housing and a housing cover.
FIG. 6B is a cross-sectional view illustrating a state at the time of movement of a diaphragm of the second embodiment.
Figure 6:
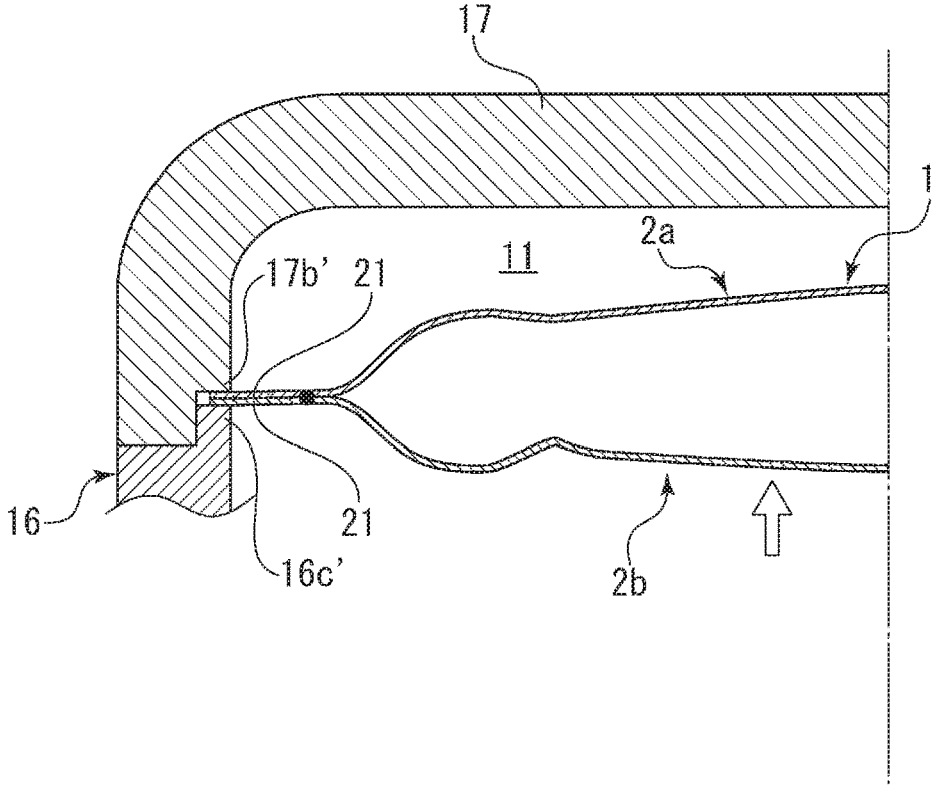

Next, a structure for attaching a metal diaphragm damper according to a second embodiment will be described with reference to FIG. 6. Meanwhile, the same components as those described in the embodiment will be denoted by the same reference numerals as those described in the embodiment, and the repeated description will be omitted.

Since a convex portions 16*c*' of a housing 16 and a convex portions 17*b*' of a housing cover 17 of the second embodiment are disposed close to each other in comparison with the first embodiment as illustrated in FIG. 6A, the outer peripheral portions 21 and 21 of the metal diaphragm damper 1 are in contact with each other in the thickness direction in a state where the outer peripheral portions 21 and 21 are held between the convex portions 16*c*' and the convex portions 17*b*'.

As illustrated in FIG. 6B, when the portions of the diaphragms 2*a* and 2*b* closer to the inside than the welded portion W receive large pulsation from one side toward the other side, the diaphragms are deformed from the edges of the outer peripheral portions 21 and 21 close to the inner peripheral sides of the convex portions 16*c*' and the convex portions 17*b*'. That is, the outer peripheral portions 21 and 21 can be made to be deformed integrally, and the elastic restoring forces of the outer peripheral portions 21 and 21 do not act when the outer peripheral portions 21 and 21 are deformed. Accordingly, the portions of the diaphragms 2*a* and 2*b* closer to the inside than the welded portion W are easily moved.

Meanwhile, the edge portions of the outer peripheral portions 21 and 21 close to the inner peripheral sides of the convex portions 16*c*' and the convex portions 17*b*' may be formed thin so that the edge portions are easily deformed, or may be formed thick so that the strength of the edge portion is increased.

Third Embodiment

Figure 7:
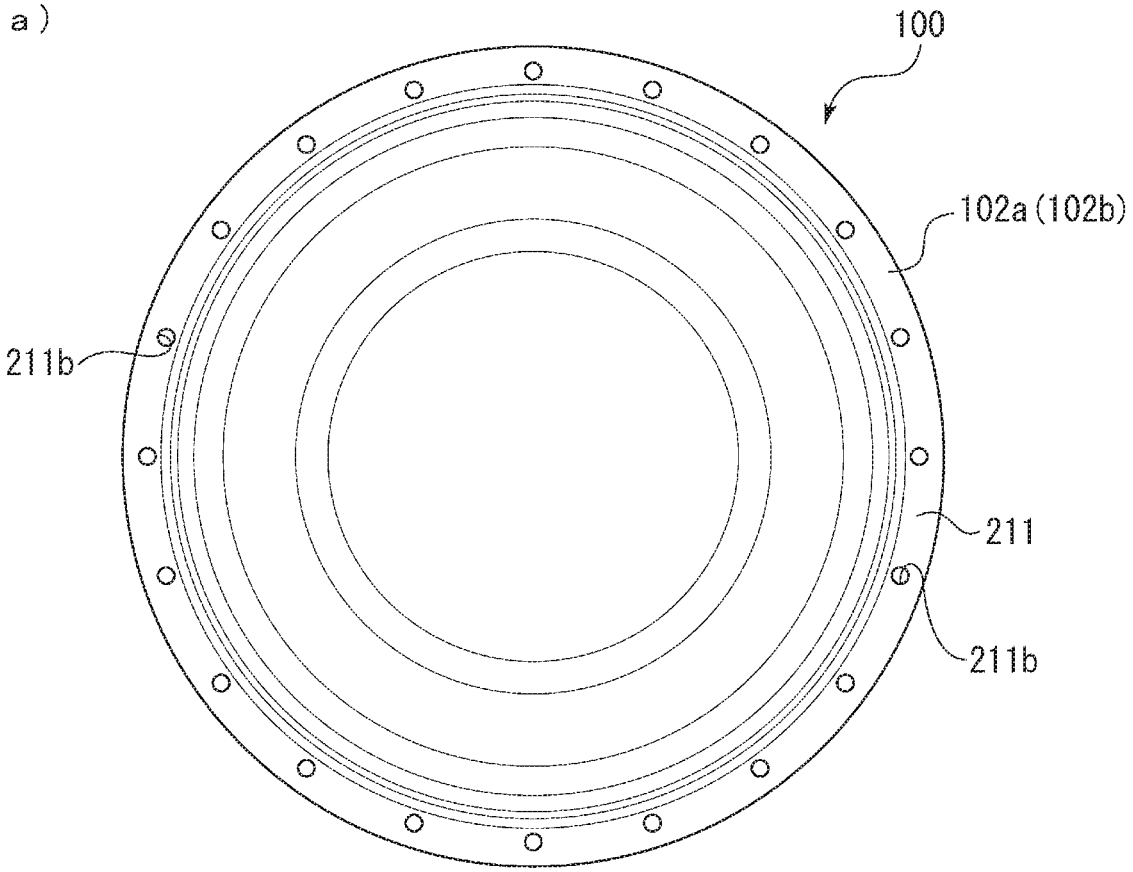
FIG. 7A is a top view illustrating a metal diaphragm damper according to a third embodiment of the present invention.
FIG. 7B is a cross-sectional view illustrating a state where the metal diaphragm damper according to the third embodiment is attached between a housing and a housing cover.
Figure 7:
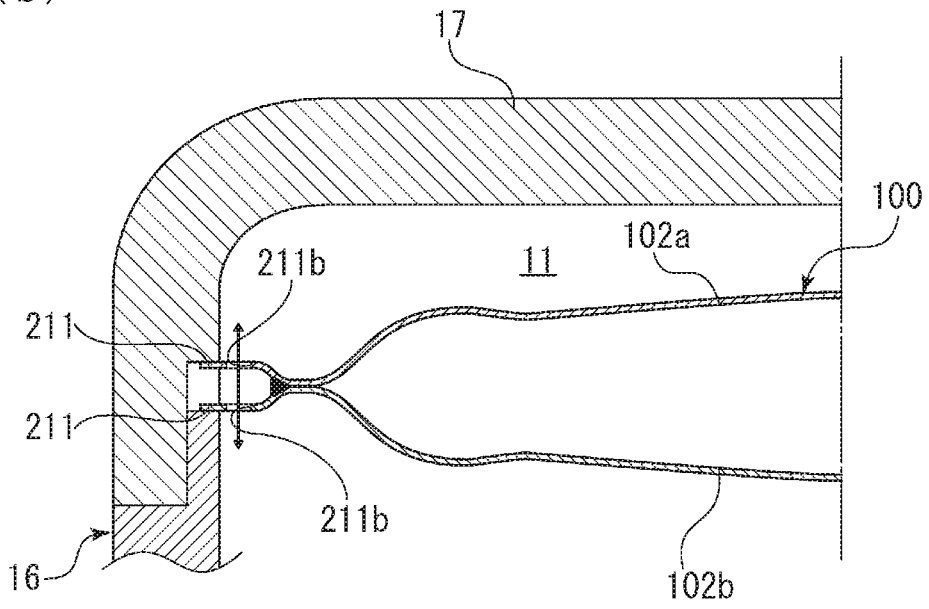

Next, a structure for attaching a metal diaphragm damper according to a third embodiment will be described with reference to FIG. 7. Meanwhile, the same components as those described in the embodiment will be denoted by the same reference numerals as those described in the embodiment, and the repeated description will be omitted.

As illustrated in FIG. 7A, a plurality of through-hole 211*b*, which penetrates diaphragms 102*a* and 102*b* in a thickness direction and have a circular shape in plan view, are formed at the respective outer peripheral portions 211 of the diaphragms 102*a* and 102*b* of a metal diaphragm damper 100 of the third embodiment to be spaced apart from each other in a circumferential direction. Since the respective through-holes 211*b* are disposed in the fuel chamber 11 in a state where the metal diaphragm damper 100 is attached between the housing 16 and the housing cover 17, fuel can be moved to one side and the other side of the metal diaphragm damper 100 through the respective through-holes 211*b* as illustrated in FIG. 7B. Meanwhile, the through-hole 211*b* is not limited to a circular shape in plan view, and may have, for example, an elliptical shape (or a slotted hole), a rectangular shape, or the like in plan view.

The embodiments of the present invention have been described above with reference to the drawings, but specific configuration is not limited to the embodiments. Even though modifications or additions are provided without departing from the scope of the present invention, the modifications or additions are included in the present invention.

For example, the diaphragms 2*a* and 2*b* have been joined to each other by laser welding in the description of the first to third embodiments, but are not limited thereto. As long as the hermetically sealed space S3 can be formed between the diaphragms 2*a* and 2*b*, the diaphragms 2*a* and 2*b* may be joined to each other by various types of welding, caulking, or the like.

Further, forms that include both the communication passages (the notches 21*a* or the through-holes 211*b*) of the metal diaphragm damper and the communication passages (the gaps S1 and S2) of the housing and the housing cover have been exemplified in the first to third embodiments, but at least any one of the metal diaphragm damper or the housing and the housing cover may be provided with the communication passages.

The first curved portions 22*a* and 22*a* have been in contact with each other over the circumferential direction in the first to third embodiments, but are not limited thereto. A plurality of protrusions may be provided in the circumferential direction on the base end portions (portions close to the welded portion W) of the curved portions, and the protrusions may be in contact with each other.

Further, a restriction member for restricting excessive elastic deformation of the diaphragms 2*a* and 2*b* (particularly, curved portions 22) may be disposed in the metal diaphragm damper 1. In this case, it is preferable that the restriction member has a shape allowing the appropriate volume change ratios of the diaphragms 2*a* and 2*b*. Furthermore, it is preferable that the restriction member is made of a material not allowing the breakage of the diaphragms 2*a* and 2*b* caused by the contact between the restriction member and the diaphragms when the diaphragms 2*a* and 2*b* are elastically deformed.

Moreover, the diaphragms 2*a* and 2*b* that include the curved portions 22 having an S-shaped cross-section and the dome-shaped deformable-action portions 23 have been described in the embodiments, but the shape of the diaphragm may be freely designed. For example, the diaphragm may have a shape that includes a deformable-action portion having a linear cross-section and a curved portion provided at the outer edge of the deformable-action portion and having a circular arc-shaped cross-section.

REFERENCE SIGNS LIST

1 Metal diaphragm damper
2*a*, 2*b* Diaphragm
10 High-pressure fuel pump
11 Fuel chamber (space)
16 Housing
16*c*, 16*c*' Convex portion
16*d* Concave portion
17 Housing cover
17*b*, 17*b*' Convex portion
17*c* Concave portion
21 Outer peripheral portion
21*a* Notch (communication passage)
22 Curved portion
22*a* First curved portion (contact portion)
22*b* Second curved portion
23 Deformable-action portion S1, S2 Gap (communication passage, communication groove)

S3 Hermetically sealed space

W Welded portion

The invention claimed is:

1. A structure for attaching a metal diaphragm damper, comprising:

a housing;

a housing cover that cooperates with the housing to define a space between the housing and the housing cover; and a pair of diaphragms each formed in a disk shape, the pair of diaphragms having weld portions on an outer periphery side thereof, the weld portions being welded to each other in an annular shape to form the metal diaphragm damper of which inside is filled with gas, the metal diaphragm damper being attached to the housing and the housing cover so as to be disposed in the space between the housing and the housing cover, wherein the pair of diaphragms is provided with outer peripheral portions on the outer peripheral side of the welded portions, and the outer peripheral portions of the pair of diaphragms are held by the housing and the housing cover in a thickness direction of the pair of diaphragms.

2. The structure for attaching a metal diaphragm damper according to claim 1, wherein the outer peripheral portions of the pair of diaphragms are formed to be opened in a direction where the outer peripheral portions are spaced apart from each other as going toward the outside in a radial direction.

3. The structure for attaching a metal diaphragm damper according to claim 1, wherein the outer peripheral portions are provided with communication passages which allow both sides of the outer peripheral portions in a thickness direction thereof to communicate with each other.

4. The structure for attaching a metal diaphragm damper according to claim 3, wherein the communication passages are formed by cutouts of outer edges of the outer peripheral portions.

5. The structure for attaching a metal diaphragm damper according to claim 3, wherein communication grooves are formed over the housing and the housing cover.

6. The structure for attaching a metal diaphragm damper according to claim 1, wherein the pair of diaphragms is provided with curved portions which are formed on an inner peripheral side of the weld portions so as to be spaced apart from each other as going toward a radially inward side from base end portions inwardly continuous with the welded portions, the base end portions being brought into contact with each other.

7. The structure for attaching a metal diaphragm damper according to claim 1, wherein the outer peripheral portions of the pair of diaphragms are held by the housing and the housing cover in a state where the outer peripheral portions of the pair of diaphragms are spaced from each other.

8. The structure for attaching a metal diaphragm damper according to claim 1, wherein the outer peripheral portions of the pair of diaphragms are held by the housing and the housing cover in a state where the outer peripheral portions of the pair of diaphragms are in contact with each other.

9. The structure for attaching a metal diaphragm damper according to claim 2, wherein the outer peripheral portions are provided with communication passages which allow both sides of the outer peripheral portions in a thickness direction thereof to communicate with each other.

10. The structure for attaching a metal diaphragm damper according to claim 9, wherein the communication passages are formed by cutouts of outer edges of the outer peripheral portions.

11. The structure for attaching a metal diaphragm damper according to claim 4, wherein communication grooves are formed over the housing and the housing cover.

12. The structure for attaching a metal diaphragm damper according to claim 9, wherein communication grooves are formed over the housing and the housing cover.

13. The structure for attaching a metal diaphragm damper according to claim 10, wherein communication grooves are formed over the housing and the housing cover.

14. The structure for attaching a metal diaphragm damper according to claim 3, wherein the pair of diaphragms is provided with curved portions which are formed on an inner peripheral side of the weld portions so as to be spaced apart from each other as going toward a radially inward side from base end portions inwardly continuous with the welded portions, the base end portions being brought into contact with each other.

15. The structure for attaching a metal diaphragm damper according to claim 4, wherein the pair of diaphragms is provided with curved portions which are formed on an inner peripheral side of the weld portions so as to be spaced apart from each other as going toward a radially inward side from base end portions inwardly continuous with the welded portions, the base end portions being brought into contact with each other.

16. The structure for attaching a metal diaphragm damper according to claim 5, wherein the pair of diaphragms is provided with curved portions which are formed on an inner peripheral side of the weld portions so as to be spaced apart from each other as going toward a radially inward side from base end portions inwardly continuous with the welded portions, the base end portions being brought into contact with each other.

17. The structure for attaching a metal diaphragm damper according to claim 2, wherein the outer peripheral portions of the pair of diaphragms are held by the housing and the housing cover in a state where the outer peripheral portions of the pair of diaphragms are spaced from each other.

18. The structure for attaching a metal diaphragm damper according to claim 3, wherein the outer peripheral portions of the pair of diaphragms are held by the housing and the housing cover in a state where the outer peripheral portions of the pair of diaphragms are in contact with each other.

19. The structure for attaching a metal diaphragm damper according to claim 4, wherein the outer peripheral portions of the pair of diaphragms are held by the housing and the housing cover in a state where the outer peripheral portions of the pair of diaphragms are spaced from each other.

20. The structure for attaching a metal diaphragm damper according to claim 5, wherein the outer peripheral portions of the pair of diaphragms are held by the housing and the housing cover in a state where the outer peripheral portions of the pair of diaphragms are in contact with each other.

* * * * *